US010048609B2

(12) United States Patent
Sun et al.

(10) Patent No.: US 10,048,609 B2
(45) Date of Patent: Aug. 14, 2018

(54) TONER FORMULATION INCLUDING A SOFTENING AGENT AND METHOD OF PREPARING THE SAME

(71) Applicant: LEXMARK INTERNATIONAL, INC., Lexington, KY (US)

(72) Inventors: Jing X Sun, Lexington, KY (US); Cory Nathan Hammond, Winchester, KY (US); Jacob Gordon Flora, Georgetown, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/269,056

(22) Filed: Sep. 19, 2016

(65) Prior Publication Data

US 2018/0081290 A1 Mar. 22, 2018

(51) Int. Cl.

| | |
|---|---|
| ***G03G 9/093*** | (2006.01) |
| ***G03G 9/087*** | (2006.01) |
| ***G03G 9/09*** | (2006.01) |
| ***G03G 9/08*** | (2006.01) |

(52) U.S. Cl.

CPC ..... *G03G 9/09364* (2013.01); *G03G 9/0819* (2013.01); *G03G 9/0827* (2013.01); *G03G 9/08711* (2013.01); *G03G 9/08755* (2013.01); *G03G 9/0918* (2013.01); *G03G 9/09328* (2013.01); *G03G 9/09371* (2013.01); *G03G 9/09392* (2013.01)

(58) Field of Classification Search

CPC ..... G03G 9/09364; G03G 9/0827; G03G 9/09392; G03G 9/0819; G03G 9/08755; G03G 9/09371; G03G 9/0918; G03G 9/08711; G03G 9/09328

See application file for complete search history.

(56) References Cited

U.S. PATENT DOCUMENTS 5,886,101 A * 3/1999 Sommerfeld ..... C08F 255/06 525/112

OTHER PUBLICATIONS

The Condensed Chemical Dictionary, Tenth Edition Revised by Gessner G. Hawley, pp. 601-102, 705.*

Journal of Polymer Science, vol. XXXIII, pp. 101-117 (1958), Microgel: An Idealized Polymer Molecule.*

* cited by examiner

*Primary Examiner* — Thorl Chea

(57) ABSTRACT

A chemically prepared core shell toner formulation for use in electrophotography having an inventive softening agent consisting of a core shell latex having an encapsulated interpenetrating polymer network microgel in the core of the toner is disclosed. Having this core shell latex with an encapsulated IPN microgel in the core of the toner results in a toner that can simultaneously fuse at a desirable low temperature and survive the temperature extremes associated with shipping and storage.

11 Claims, No Drawings

TONER FORMULATION INCLUDING A SOFTENING AGENT AND METHOD OF PREPARING THE SAME

CROSS REFERENCES TO RELATED APPLICATIONS

None.

BACKGROUND

Field of the Disclosure

The present invention relates generally to a chemically prepared core shell toner formulation for use in electrophotography and more particularly to a chemically prepared core shell toner formulation including an inventive softening agent consisting of a core shell latex having an encapsulated interpenetrating polymer network microgel in the core of the toner and method to make the same. Having this core shell latex with an encapsulated IPN microgel in the core of the toner results in a toner that can simultaneously fuse at a desirable low temperature and survive the temperature extremes associated with shipping and storage.

Description of the Related Art

Toners for use in electrophotographic printers include two primary types, mechanically milled toners and chemically prepared toners (CPT). Chemically prepared toners have significant advantages over mechanically milled toners including better print quality, higher toner transfer efficiency and lower torque properties for various components of the electrophotographic printer such as a developer roller, a fuser belt and a charge roller. The particle size distribution of CPTs is typically narrower than the particle size distribution of mechanically milled toners. The size and shape of CPTs are also easier to control than mechanically milled toners.

One process for preparing a CPT is by emulsion aggregation. Emulsion aggregation is carried out in an aqueous system resulting in good control of both the size and shape of the toner particles. The toner components typically include a polymer binder, one or more colorants and a release agent. A styrene-acrylic copolymer polymer binder is often used as the latex binder in the emulsion aggregation process. Also, a more expensive polyester polymer binder can be used as the latex binder in the emulsion aggregation process. However, polyester binders are more difficult to disperse in an aqueous system due to their polar nature, pH sensitivity and gel content thereby limiting their applicability in the emulsion aggregation process.

The use of a styrene-acrylic copolymer latex binders in toner formulations unfortunately requires a tradeoff between the toner's fusing properties and its shipping and storage properties. One important characteristic of any toner is its fuse window. The fuse window is the range of temperatures at which fusing is satisfactorily conducted without incomplete fusion and without transfer of toner to the heating element, which may be a roller, belt or other member contacting the toner during fusing. Thus, below the low end of the fuse window the toner is incompletely melted and above the high end of the fuse window the toner flows onto the fixing member where it mars subsequent sheets being fixed. It is preferred that the low end of the fuse window be as low as possible to reduce the required temperature of the fuser in the electrophotographic printer to therefore improve the printer's safety and to conserve energy.

In addition to fusing at an energy saving low temperature, the toner must also be able to survive the temperature and humidity extremes associated with storage and shipping—commonly called the ship/store test. Caking or blocking of the toner during shipping and storage usually results in print flaws. Energy saving low fusing toner is desirable but the low end of the fuse window cannot be so low that the toner melts during the storing or shipping of a toner cartridge containing the toner. A low melt/low energy fusing toner must be robust to shipping and storage conditions in order to be attractive in a worldwide market. However, many toner formulations using polyester and or styrene acrylic latexes cannot simultaneously meet the demand to fuse at low temperatures while also passing the ship/storage tests. In particular, toners having low molecular weight polyester resins do not significantly open the low temperature end of the fuse window to allow the toner to be energy efficient. Moreover, due to its short chain migration speed, the amount of the polyester resin must be limited in the toner formulation in order for the toner to survive the temperatures and humidity extremes when being shipped and stored.

Plasticizing agents have been added to toner formulations to act as low temperature fusing promoters. However, many plasticizing agents have limitations. For example, crystalline polyester resins have been incorporated as plasticizing agents in core shell toner formulations. The incorporation of crystalline polyester resins into the toner formulation is an expensive, time consuming process. Moreover, a crystalline polyester resin having too low a melt temperature can completely melt during the emulsion aggregation process and unfortunately lead to the loss of the crystallinity of the polyester resin. Once the crystallinity disappears, the crystalline polyester will sabotage the ship store property of the toner.

The inventors of the present invention believe that lower fusing temperatures in a chemically prepared toner can be achieved by the addition of a unique softening agent into the core of the toner. This softening agent is core shell latex having an encapsulated interpenetrating polymer network (hereinafter 'IPN') microgel. A useful latex is styrene acrylic although other polymers could be used to form the latex. The core shell styrene acrylate latex having an encapsulated IPN microgel is formed by the encapsulation of a self-crosslinkable oil and or wax in the styrene acrylic latex. Having this particular IPN microgel in the core of the toner results in a toner formulation that fuses at an energy efficient low temperature and alleviates shipping and storage concerns while providing great print quality. Additionally this toner formulation has a sufficiently low melt flow viscosity to enable the penetration of the toner into paper fibers thereby giving the toner good fixation under such low melting temperatures. This toner formulation also has enough filming strength to withstand the lifting/peeling actions at higher printing speeds at the operational temperature range of the electrophotographic printer. The crosslinked structure of this styrene acrylic latex combined with a self-crosslinkable oil, such as a silane coupling system, forms an IPN microgel that promotes the low temperature melting at fusing but no polymer migration during shipping and storage.

SUMMARY

A method for producing toner for electrophotography according to one embodiment, includes the preparing of the softening agent consisting of a core shell styrene acrylic latex having an encapsulated IPN microgel. The method includes preparing the styrene acrylic latex, preparing a monomer solution, seeding the styrene acrylic latex with a portion of the monomer solution, a self-crosslinkable oil, a crosslinking agent, a surfactant, and a chain transfer agent and adding an initiator/surfactant solution and a remaining portion of the monomer solution to the seeded styrene acrylic latex. Separately, a first and a second polymer emulsions as well as a pigment dispersion and a wax emulsion are prepared. The first polymer emulsion is then combined and agglomerated with the pigment dispersion and wax emulsion and the above described styrene acrylic latex having an encapsulated IPN microgel to form toner cores. An optional borax coupling agent is added to the toner cores once the toner cores reach a predetermined size. The second polymer emulsion is combined and agglomerated with the toner cores to form toner shells around the toner cores. The toner cores and toner shells are then fused to form toner particles.

A chemically prepared toner composition, according to one example embodiment includes a toner particle having a core including a first polymer binder, a softening agent including a core shell styrene acrylic latex having an encapsulated IPN microgel, a pigment, a wax, and a shell formed around the core including a second polymer binder. An optional borax coupling agent can be placed between the outer surface of the core and the shell to assist in the binding of the polymer found in the shell onto the surface of the toner core containing the first polymer.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced item.

The present disclosure relates to a chemically prepared toner having a core shell latex having an encapsulated IPN microgel in the core of the toner and an associated method of preparation of the toner. An IPN is a combination of two polymers in network form. One of the networks is synthesized and or crosslinked in the immediate presence of the other. In the IPN microgel of the present invention, two types of networks combine to form the IPN. In an embodiment, the first network consists of an acrylate polymer crosslinking system. The second network is a silane coupling system including a self-crosslinkable silicon oil. The styrene acrylic latex containing an encapsulated IPN microgel act as a desirable softening agent or low temperature fusing promoter when incorporated into the core of the toner. The toner is utilized in an electrophotographic printer such as a printer, copier, multi-function device or an all-in-one device. The toner may be provided in a cartridge that supplies toner to the electrophotographic printer. Example methods of forming toner using emulsion aggregation techniques are found in U.S. Pat. Nos. 6,531,254 and 6,531,256, which are incorporated by reference herein in their entirety. Additionally, U.S. Pat. Nos. 8,669,035 and 9,023,569 disclose example toner formulations and methods of making toner using a borax coupling agent and are assigned to the applicants of the present invention and are incorporated by reference herein in their entirety.

In the present emulsion aggregation process, the toner particles are manufactured by chemical methods as opposed to physical methods such as pulverization. Generally, the toner includes one or more polymer binders, a core shell latex having an IPN microgel core, a release agent or wax, a colorant, an optional borax coupling agent and one or more optional additives such as a charge control agent (CCA).

The styrene acrylic latex used herein is a core shell structure with low molecular weight, low glass transition temperature (Tg), relative highly cross-linked latex. Additionally the styrene acrylic latex contains an IPN microgel. This styrene acrylic latex has these requirements because typically a styrene acrylic latex used in toner provides better ship store property for the toner, however its use will deteriorate the toner's fusing properties dramatically due to the thermal characteristics of the styrene acrylic resin itself. Additionally the latex used in this toner formulation should enable the toner to reach its required circularity without changing the emulsion aggregation process to make the polyester toner, which typically rounds at relatively lower temperature and atmosphere pressure. This specially designed core shell styrene acrylic latex containing an encapsulated IPN microgel attains the above enumerated properties.

This specially designed core shell styrene acrylic latex containing an encapsulated IPN microgel is synthesized using the following steps. The first step is an IPN microgel formation process and the second step is an encapsulation process that involves latex emulsion polymerization to form a shell over the IPN microgel. A monomer solution is prepared using styrene and acrylate monomers with crosslinking agents and chain transfer agents. An initiator solution is prepared separately in water with an inorganic base such as sodium hydroxide and a surfactant. A portion of the monomer solution is used as an organic seed and added with the self-crosslinkable oil. The organic seed, together with the radical initiator and the surfactant are held at a temperature near or about 82° C. for about 20 to 25 minutes to form the cross-linked styrene acrylic polymer based IPN microgel. The rest of the monomer solution and the initiator solution are then added to the formed core over a period of time to create the shell for the IPN microgel. The reaction is held for another 2 hours and cooled to room temperature. The resulting latex having the styrene acrylic particles containing an encapsulated IPN microgel core is then filtered through a mesh to eliminate large grits. This resulting latex having the styrene acrylic latex containing an encapsulated IPN microgel is then used as the softening agent in the core of the toner formulation.

A detailed synthesis of the toner of the present invention is set forth as follows: An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A−), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used together with the above described styrene acrylic latex containing an encapsulated IPN microgel to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used in the core and shell. In the emulsion aggregation toner, different polymer latexes are used for the core and shell of the toner. The ratio of the amount of polyester binder in the toner core to the amount of polyester binder in the shell is between about 20:80 (wt.) and about 80:20 (wt.) including all values and increments therebetween, such as between about 50:50 (wt.) and about 80:20 (wt.), depending on the particular polyester resin(s) used.

The core shell styrene acrylic latex having an encapsulated IPN microgel, colorant, release agent and the optional CCA are dispersed separately in their own aqueous environments or in one aqueous mixture, as desired, in the presence of a stabilizing agent having similar functionality (and ionic charge) as the stabilizing agent employed in the polymer latex. This styrene acrylic latex, polymer latex forming the toner core, the colorant dispersion, the release agent dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated toner particles may then be heated to a temperature that is less than or around (e.g., ±5° C.) the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The toner particles produced may have an average particle size of between about 3 μm and about 20 μm (volume average particle size) including all values and increments therebetween, such as between about 4 μm and about 15 μm or, more particularly, between about 5 μm and about 7 μm. The toner particles produced may have an average degree of circularity between about 0.90 and about 1.00, including all values and increments therebetween, such as about 0.93 to about 0.98. The average degree of circularity and average particle size may be determined by a Sysmex Flow Particle Image Analyzer (e.g., FPIA-3000) available from Malvern Instruments, Ltd., Malvern, Worcestershire, UK. The various components for the emulsion aggregation method to prepare the above referenced toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Core Shell Latex

There are several factors to consider when formulating a core shell latex that will successfully function as a softening agent or low temperature fusing promoter when added into the core of a core shell toner formulation. This latex contains an encapsulated IPN microgel and is incorporated into the core of the toner along with the other usual components of the toner core such as a polymer, pigment, release agent and the like. Having a toner with this type of softening agent in the core of the toner microgel positively affects the toner fusing temperature and ship/store properties. The important factors include the monomer selected, the cross-linking agent, the chain transfer agent, and the self-crosslinkable oil used to form the IPN microgel.

1. Monomer Selection

The latex is formed from monomers. Hydrophobic monomers may be selected from a group including, but not limited to, styrene, butyl acrylate, lauryl acrylate, and stearyl methacrylate. Hydrophobic refers to a relatively non-polar type chemical structure that tends to self-associate in the presence of water. Lauryl acrylate or butyl acrylate is used with styrene. Although longer chain lengths hydrocarbons are preferred for the interaction of the monomer with the wax and other resins in the toner, the longer the hydrocarbon chain, the less efficient the monomer is in co-polymerization. Hydrophilic monomers may be selected from carboxy (—COOH), 2-acrylamido-2-methyl-1-propanesulfonic acid, and hydroxy (—OH) functional groups. The hydrophilic monomers also affect the agglomeration of the toner particle in the emulsion aggregation CPT process. Hydrophilic functionality refers to relatively polar functionality (e.g., an anionic group) which may then tend to associate with water molecules. Hydrophilic monomers provide additional stability for the latex particles apart from that already provided by the surfactant and initiator. Examples of hydrophilic monomers are hydroxyethyl methacrylate, beta-carboxyethyl acrylate. Furthermore, the quantity of the carboxy and hydroxyl functional groups in the chosen hydrophilic monomers have been found to have a great influence on the print quality and stability of the toner. Without wishing to be bound by theory, it is believed that these functional groups in the chosen monomer act as an anchor for the pigment, which in turn influences the pigment distribution in the toner particles.

2. Cross-Linking Agent

The cross-linking agent controls the gel content of the latex which, in turn, affects both fusing temperature and the migration of the latex polymers. A low molecular weight, low Tg latex is preferred, however, these properties are the opposite of those required to maintain the ship/store property of the toner. Surprisingly, cross-linking the low molecular weight polymer chain into a soft gel is a more favorable solution. In an embodiment, divinyl benzene and trimethylolpropane triacrylate are useful as cross-linking agents.

Other useful cross-linking agents include any kind of di- or multifunctional meth(acrylate).

3. Chain Transfer Agent

The chain transfer agent not only controls the molecular weight of the latex, but also affects the grit formation of the reaction. Generally, any kind of thiol compounds can be a possible chain transfer agent. In the present encapsulation process, two chain transfer agents are used: 1-dodecanethiol and isooctyl-3-mercaptopropionate.

4. Self-Crosslinkable Oil

The self-crosslinkable oil used in the latex preferably contains a long chain (carbon number >6) hydrocarbon. Additionally, the self-crosslinkable oil cannot be water soluble. This oil can be chosen from the following pure or mixed chemicals: mono, di, or trimethoxysilane hydrocarbons; mono, di, or triethoxysilane hydrocarbons; such as n-octyltrimethoxysilane, 7-octenyltrimethoxysilane, n-octylmethyldiethoxysilane, n-octadecyltrimethoxysilane, 1,3-di-n-octyltetraethoxydisiloxane, methacryloxypropylmethyldimethoxysilane. The quantity of the encapsulated self-crosslinkable oil is preferred to be about 0.5-2.5% of the latex. A useful self-crosslinkable oil is n-octyltrimethoxysilane.

Ammonium persulfate is used in the initiator solution and a surfactant such as AKYPO-M100 is used together with the organic seed. AKYPO-M100 is available from Kao Corporation, Bunka Sumida-ku, Tokyo, Japan.

A latex having a low Tg is preferred when used as a softening agent in the core of the toner. Particularly based on the quantity of the latex used in the toner, a latex having a low molecular weight, medium cross-linking and a Tg between about 20° C. to about 80° C. is preferred in order to achieve the desirable energy efficient low temperature fusing of 175° C. or lower. An embodiment uses a latex having a Tg between 40° C. to 60° C. In some embodiments, the latex portion can be up to 25% wt of the total resin. In an embodiment, the latex is about 20% wt of the total resin.

As mentioned above, the toners herein include one or more polymer binders. The terms resin and polymer are used interchangeably herein as there is no technical difference between the two. In one embodiment, the polymer binder(s) include polyesters. The polyester binder(s) may include a semi-crystalline polyester binder, a crystalline polyester binder or an amorphous polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof. The polymer binder(s) also includes a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacrylate copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins. Various commercially available crystalline polyester resin emulsions are available from Kao Corporation, Bunka Sumida-ku, Tokyo, Japan and Reichhold Chemical Company, Durham, N.C. under the trade names EPC 2-20, EPC 3-20, 6-20, 7-20, CPES B1, EPC 8-20, EPC 9-20, EPC-10-20, CPES B20 and CPES B25.

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing colorant may be used thereby permitting omission of the dispersant. The colorant may be present in the dispersion at a level of about 5% to about 20% by weight including all values and increments therebetween. For example, the colorant may be present in the dispersion at a level of about 10% to about 15% by weight. The dispersion of colorant may contain particles at a size of about 50 nanometers (nm) to about 500 nm including all values and increments therebetween. Further, the colorant dispersion may have a pigment weight percent divided by dispersant weight percent (P/D ratio) of about 1:1 to about 8:1 including all values and increments therebetween, such as about 2:1 to about 5:1. The colorant may be present at less than or equal to about 15% by weight of the final toner formulation including all values and increments therebetween.

The optional coupling agent used herein is borax (also known as sodium borate, sodium tetraborate, or disodium tetraborate). As used herein, the term borax coupling agent is defined as enabling the formation of hydrogen bonds between polymer chains which assists in the anchoring or binding of the polymer found in the shell onto the surface of the toner core containing the polymers or mixture of polymers, thereby helping to couple the shell to the outer surface of the toner core. The borax coupling agent bonds the shell to the outer surface of the core by forming hydrogen bonding between its hydroxyl groups and the functional groups present in the polymers utilized in the inventive toner formulation.

Typically, coupling agents have multivalent bonding ability. Borax differs from commonly used permanent coupling agents, such as multivalent metal ions (e.g., aluminum and zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded thereto. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

The wax used may include any compound that facilitates the release of toner from a component in an electrophotographic printer (e.g., release from a roller surface). The term 'release agent' can also be used to describe a compound that facilitates the release of toner from a component in an electrophotographic printer. For example, the release agent or wax may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters or mixtures thereof.

The wax or release agent may therefore include a low molecular weight hydrocarbon based polymer (e.g., Mn≤10,000) having a melting point of less than about 140° C. including all values and increments between about 50° C. and about 140° C. The wax may be present in the dispersion at an amount of about 5% to about 35% by weight including all values and increments there between. For example, the wax may be present in the dispersion at an amount of about 10% to about 18% by weight. The wax dispersion may also contain particles at a size of about 50 nm to about 1 μm including all values and increments there between. In addition, the wax dispersion may be further characterized as having a wax weight percent divided by dispersant weight percent (RA/D ratio) of about 1:1 to about 30:1. For example, the RA/D ratio may be about 3:1 to about 8:1. The wax is provided in the range of about 2% to about 20% by weight of the final toner formulation including all values and increments there between. Exemplary waxes having these above enumerated characteristics include, but are not limited to, SD-A01, SD-B01, MPA-A02, CM-A01 and CM-B01 from Cytech Products, Inc., Polywax M70, Polywax M80 and Polywax 500 from Baker Petrolite and WE5 from Nippon Oil and Fat.

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. No. 6,991,884 and U.S. Pat. No. 5,714,538, which are assigned to the assignee of the present application and are incorporated by reference herein in their entirety.

The surfactant, as used herein, may be a conventional surfactant known in the art for dispersing non self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, extra particular additives, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof.

The following examples are provided to further illustrate the teachings of the present disclosure, not to limit the scope of the present disclosure.

Preparation of Example Cyan Pigment Dispersion

About 10 g of AKYPO RLM-100 polyoxyethylene(10) lauryl ether carboxylic acid from Kao Corporation, Bunka Sumida-ku, Tokyo, Japan was combined with about 350 g of de-ionized water and the pH was adjusted to ~7-9 using sodium hydroxide. About 10 g of Solsperse 27000 from Lubrizol Advanced Materials, Cleveland, Ohio, USA was added and the dispersant and water mixture was blended with an electrical stirrer followed by the relatively slow addition of 100 g of pigment blue 15:3. Once the pigment was completely wetted and dispersed, the mixture was added to a horizontal media mill to reduce the particle size. The solution was processed in the media mill until the particle size was about 200 nm. The final pigment dispersion was set to contain about 20% to about 25% solids by weight.

Preparation of Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 12 g of ester wax and 48 g of paraffin wax from Cytec Products Inc., Elizabethtown, Ky. was added to the hot mixture while the temperature was maintained at about 90° C. for about 15 minutes. The emulsion was then removed from the microfluidizer when the particle size was below about 250 nm. The solution was then stirred at room temperature. The wax emulsion was set to contain about 15% to about 25% solids by weight Preparation of Example Polyester Resin Emulsion A A polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 55° C. to about 58° C. at a heating rate of about 5° C. per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 7 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23 inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles. The particle size of Polyester Resin Emulsion A was between about 190 nm and about 240 nm (volume average) as measured by a NANOTRAC Particle Size Analyzer. The pH of the resin solution was between about 6.5 and about 7.0.

Preparation of Example Polyester Resin Emulsion B

A polyester resin having a peak molecular weight of about 13K, a glass transition temperature of about 58° C. to about 62° C., a melt temperature of about 110° C., and an acid value of about 20 to 23 was used to form an emulsion using the procedure outlined above to make example Polyester Resin Emulsion A except using about 10 g of the 10% potassium hydroxide (KOH) solution. The particle size of Polyester Resin Emulsion B was between about 190 nm and about 240 nm (volume average) as measured by a NANOTRAC Particle Size Analyzer. The pH of the resin solution was between about 6.5 and about 7.0.

Preparation of Different Latexes to be Used as a Softening Agent in Core of Toner Latex A Having an Encapsulated Oil In flask A, 4.48 g 2-hydroxyethyl methacrylate, 2.57 g β-carboxyethyl acrylate, 1.9276 g 1-dodecanethiol, 1.9082 g isooctyl-3-mercaptopropionate, 110 g styrene and 32 g lauryl acrylate were weighed and mixed.

In flask B, 1.25 g farnesol, 0.5 g trimethylolpropane triacrylate and 8 g mixture from flask A were mixed.

In flask C, 0.6 g divinylbenzene and 70 g mixture from flask A were mixed.

In flask D, 1.1 g divinylbenzene and the rest of the mixture in flask A were mixed.

The initiator solution was prepared in another flask F with 70 g of deionized water, 0.3 g of ammonium persulfate, 9.0 g of 15% AKYPO-M100 and 2.0 g of ammonium hydroxide.

In a 3 L four-neck, round-bottom flask equipped with a thermocontroller, condenser, mechanical stirrer and nitrogen inlet, about 500 g deionized water, 1.0 g of Akypo surfactant and 1.6 g of Ammonium hydroxide were added and heated to 82° C. At 82° C., the mixture in flask B with 0.11 g ammonium persulfate were added and held for 25 minutes. The mixture in flask C and initiator solution in flask F were added drop-wise to the reactor in a speed ratio of 3:1 while maintaining the temperature at 82° C. The addition continued for approximately 32 min. until completion. Then the mixture in flask D was added at the same speed. At approximately four hours, 0.19 g of t-Butyl hydroperoxide and 0.13 g of L-ascorbic acid in 25 ml of deionized water (respectively) were added separately to the reactor. The reaction was held for another two hours and cooled down to room temperature. The product was filtered through a mesh. The final particle size was around 94 nm. This final product is referred to as Encapsulated Oil Latex A.

Latex B Having an Encapsulated Oil

In flask A, 2-hydroxyethyl methacrylate 4.48 g, β-carboxyethyl acrylate 2.57 g, 1-dodecanethiol 1.9276 g, isooctyl-3-mercaptopropionate 1.9082 g, styrene 110 g and lauryl acrylate 32 g were weighed and mixed.

In flask B, 1.25 g farnesol, 0.5 g trimethylolpropane triacrylate and 8 g mixture from flask A were mixed.

In flask C, 0.6 g divinylbenzene and 70 g mixture from flask A were mixed.

In flask D, 1.1 g divinylbenzene and the rest of the mixture in flask A were mixed.

In flask E, 0.7 g of 2-acrylamido-2-methyl-1-propanesulfonic acid with 0.35 g of ammonium hydroxide and 10 g deionized water were mixed The initiator solution is prepared in another flask F with 70 g of deionized water, 0.3 g of ammonium persulfate, 9.0 g of 15% Akypo solution and 2.0 g of ammonium hydroxide.

In a 3 L four-neck, round-bottom flask equipped with a thermocontroller, condenser, mechanical stirrer and nitrogen inlet, about 500 g deionized water, 1.0 g of Akypo surfactant and 1.6 g of ammonium hydroxide were added and heated to 82° C. At 82° C., the mixture in flask B with 0.11 g ammonium persulfate were added, and the reaction was held for 25 minutes. The mixture in flask C and initiator solution in flask F were added drop-wise to the reactor in a speed ratio of 3:1 while maintaining the temperature at 82° C. The addition continued for approximately 32 minutes until completion. Then the mixture in flask D was added at the same speed, followed by flask E mixture. At approximately four hours, 0.19 g of t-Butyl hydroperoxide and 0.13 g of L-ascorbic acid in 25 ml of deionized water (respectively) were added separately to the reactor. The reaction was held for another two hours and cooled down to room temperature. The product was filtered through a mesh. The final particle size was around 106 nm. This final product is referred to as Encapsulated Oil Latex B.

Core Shell Latex Having an Encapsulated IPN microgel

Latex 1 Having an Encapsulated IPN Microgel

In flask A, 2-hydroxyethyl methacrylate 4.48 g, β-carboxyethyl acrylate 2.57 g, 1-dodecanethiol 1.9276 g, isooctyl-3-mercaptopropionate 1.9082 g, styrene 110 g and lauryl acrylate 32 g were weighed and mixed.

In flask B, 1.25 g octadecyltrimethoxysilane, 0.5 g trimethylolpropane triacrylate and 8 g mixture from flask A were mixed.

In flask C, 0.6 g divinylbenzene and 70 g mixture from flask A were mixed.

In flask D, 1.1 g divinylbenzene and the rest of the mixture in flask A were mixed.

In flask E, 0.7 g of 2-acrylamido-2-methyl-1-propanesulfonic acid with 0.35 g of ammonium hydroxide and 10 g deionized water were mixed.

The initiator solution was prepared in another flask F with 70 g of deionized water, 0.3 g of ammonium persulfate, 9.0 g of 15% Akypo solution and 2.0 g of ammonium hydroxide.

In a 3 L four-neck, round-bottom flask equipped with a thermocontroller, condenser, mechanical stirrer and nitrogen inlet, about 500 g deionized water, 1.0 g of Akypo surfactant and 1.6 g of ammonium hydroxide were added and heated to 82° C. At 82° C., the mixture in flask B with 0.11 g ammonium persulfate were added and held for 25 minutes. The mixture in flask C and initiator solution in flask F were added drop-wise to the reactor in a speed ratio of 3:1 while maintaining the temperature at 82° C. The addition continued for approximately 32 min. until completion. Then the mixture in flask D was added at the same speed, followed by flask E mixture. At approximately four hours, 0.19 g of t-butyl hydroperoxide and 0.13 g of L-ascorbic acid in 25 ml of deionized water (respectively) were added separately to the reactor. The reaction was held for another two hours and cooled down to room temperature. The product was filtered through a mesh. The final particle size was around 95 nm. The final product is referred to as IPN Latex 1.

Latex 2 Having an Encapsulated IPN Microgel

In flask A, 2-hydroxyethyl methacrylate 4.48 g, β-carboxyethyl acrylate 2.57 g, 1-Dodecanethiol 1.9276 g, Isooctyl-3-mercaptopropionate 1.9082 g, styrene 110 g and laurylacrylate 32 g were weighed and mixed.

In flask B, 1.25 g octyltrimethoxysilane, 0.5 g trimethylolpropane triacrylate and 8 g mixture from flask A were mixed.

In flask C, 0.6 g divinylbenzene and 70 g mixture from flask A were mixed.

In flask D, 1.1 g divinylbenzene and the rest of the mixture in flask A were mixed.

In flask E, 0.7 g of 2-acrylamido-2-methyl-1-propanesulfonic acid with 0.35 g of ammonium hydroxide and 10 g deionized water were mixed.

The initiator solution is prepared in flask F with 70 g of deionized water, 0.3 g of ammonium persulfate, 9.0 g of 15% Akypo solution and 2.0 g of ammonium hydroxide.

In a 3 L four-neck, round-bottom flask equipped with a thermocontroller, condenser, mechanical stirrer and nitrogen inlet, about 500 g deionized water, 1.0 g of Akypo surfactant and 1.6 g of ammonium hydroxide were added and heated to 82° C. At 82° C., the mixture in flask B with 0.11 g ammonium persulfate were added and held for 25 minutes. The mixture in flask C and initiator solution in flask F were added drop-wise to the reactor in a speed ratio of 3:1 while maintaining the temperature at 82° C. The addition continued for approximately 32 min. until completion. Then the mixture in flask D was added at the same speed, followed by flask E mixture. At approximately four hours, 0.19 g of t-butyl hydroperoxide and 0.13 g of L-ascorbic acid in 25 ml of deionized water (respectively) were added separately to the reactor. The reaction was held for another two hours and cooled down to room temperature. The product was filtered through a mesh. The final particle size was around 101 nm. The final product is referred to as IPN Latex 2.

Latex 3 Having an Encapsulated IPN Microgel

In flask A, 2-hydroxyethyl methacrylate 4.48 g, β-carboxyethyl acrylate 2.57 g, 1-dodecanethiol 1.9276 g, isooctyl-3-mercaptopropionate 1.9082 g, styrene 110 g and laurylacrylate 32 g were weighed and mixed.

In flask B, 1.25 g octyltrimethoxysilane, 0.5 g trimethylolpropane triacrylate and 8 g mixture from flask A were mixed.

In flask C, 0.6 g divinylbenzene and 70 g mixture from flask A were mixed.

In flask D, 1.1 g divinylbenzene and the rest of the mixture in flask A were mixed.

The initiator solution is prepared in flask F with 70 g of deionized water, 0.3 g of ammonium persulfate, 9.0 g of 15% Akypo solution and 2.0 g of ammonium hydroxide. In a 3 L four-neck, round-bottom flask equipped with a thermocontroller, condenser, mechanical stirrer and nitrogen inlet, about 500 g deionized water, 1.0 g of Akypo surfactant and 1.6 g of ammonium hydroxide were added and heated to 82° C. At 82° C., the mixture in flask B with 0.11 g ammonium persulfate were added and held for 25 minutes. The mixture in flask C and initiator solution in flask F were added drop-wise to the reactor in a speed ratio of 3:1 while maintaining the temperature at 82° C. The addition continued for approximately 32 min. until completion. Then the mixture in flask D was added at the same speed. At approximately four hours, 0.19 g of t-Butyl hydroperoxide and 0.13 g of L-Ascorbic acid in 25 ml of deionized water (respectively) were added separately to the reactor. The reaction was held for another two hours and cooled down to room temperature. The product was filtered through a mesh. The final particle size was around 82 nm. The final product is referred to as IPN Latex 3.

Toner Formulation Examples

Toner A Having Encapsulated Oil Latex A

Components were added to a 2 L reactor in the following amounts: about 232.65 g of Encapsulated Oil Latex A with 19.05% wt solid, 391.61 g of 29.76% wt Example Polyester Resin Emulsion A, 52.74 g of the Cyan Pigment Dispersion (with 29.10% wt solid and 5:1 Pigment-to-Dispersant ratio), 99.52 g of the 34.40% Example Wax Emulsion with wax-to-dispersant ratio of about 28.5:1, and 834 g of the deionized water.

The mixture was mixed in the reactor at about 25° C. and a circulation loop was started consisting of a high shear mixer and an acid addition pump. The mixture was sent through the loop and the high shear mixer was set at 10,000 rpm. Acid was slowly added to the high shear mixer to evenly disperse the acid in the toner mixture so that there were no pockets of low pH. Acid addition took about 4 minutes with 210 g of 1% sulfuric acid solution. The flow of the loop was then reversed to return the toner mixture to the reactor and the temperature of the reactor was increased to about 40-45° C. Once the particle size reached 4.5 to 5.0 μm (number average), 5% borax solution (20 g of solution having 1.0 g borax) was added. After the addition of borax, 290.16 g of Example Polyester Resin Emulsion B with 29.70% wt solid was added. The mixture was stirred for about 5 minutes and the pH was monitored. Slowly heat the mixture to about 54° C. Once the particle size reached 5.5 μm (number average), 4% NaOH was added to raise the pH to about 6.7 to stop the particle growth. The reaction temperature was held for one hour. The particle size was monitored during this time period. Once particle growth stopped, the temperature was increased to 93° C. to cause the particles to coalesce. This temperature was maintained until the particles reached their desired circularity (about 0.97-0.98). The toner was then washed and dried. The toner had a volume average particle size of 6.77 μm and a number average particle size of 5.50 μm. Fines (<2 μm) were present at 0.14% (by number) and the toner possessed a circularity of 0.97.

Toner B Having Encapsulated Oil Latex B

Toner B was formed using the procedure outlined above in making Toner A, replacing the Encapsulated Oil Latex A with 235.5 g of Encapsulated Oil Latex B with 18.82% wt solid. The toner had a volume average particle size of 6.22

μm and a number average particle size of 5.10 μm. Fines (<2 μm) were present at 0.32% (by number) and the toner possessed a circularity of 0.97.

Toner 1 Having IPN Latex 1

Toner 1 was formed using the procedure outlined above in making Toner A, replacing the Encapsulated Oil Latex A with 241.53 g of IPN Latex 1 with 18.35% wt solid. The toner had a volume average particle size of 7.86 μm and a number average particle size of 6.10 μm. Fines (<2 μm) were present at 0.17% (by number) and the toner possessed a circularity of 0.97.

Toner 2 Having IPN Latex 2

Toner 2 was formed using the procedure outlined above in making Toner A, replacing the Encapsulated Oil Latex A with 235.75 g of IPN Latex 2 with 18.80% wt solid. The toner had a volume average particle size of 5.99 μm and a number average particle size of 5.03 μm. Fines (<2 μm) were present at 0.25% (by number) and the toner possessed a circularity of 0.97.

Toner 3 Having IPN Latex 3

Toner 3 was formed using the procedure outlined above in making Toner A, replacing the Encapsulated Oil Latex A with 235.5 g of IPN Latex 3 with 18.82% wt solid. The toner had a volume average particle size of 6.72 μm and a number average particle size of 5.44 μm. Fines (<2 μm) were present at 0.42% (by number) and the toner possessed a circularity of 0.97.

Control Toner

A commercially available core shell low temperature fusing polyester toner was used as the Control Toner and compared to the Toners A, B, 1, 2 and 3. The control toner is Xerox® EA-Eco toner. EA-Eco is produced using an emulsion aggregation process.

Test Results

Tg and Ship/Store Results

The ship/store test involves using 8 gm of finished toner placed in a container with a 75 gm load placed over it. The system is then subjected a temperature of 50° C. for 48 hrs. The sample is removed from the heat and torque is measured using a probe. Toners that remain low in cohesion are categorized as passing the test. The temperature can also be increased to 52° C. to create a stress test to differentiate our top toner candidates. Ship/store is determined at 50° C. using a 75 g load for 48 hours, and a result below 60 is preferred and around 60 is acceptable. An acceptable low fusing temperature for a CPT is 180-190° C. or below.

TABLE 1 shows the Tg of the different latexes and toner ship store results. Ship store is determined at 50° C. using a 75 g load for 48 hours. The lower the ship store rating, the better the result. A desirable rating is a score of below mid $60^{th}$.

The Tg of the latex should be between about 40° C.— to about 60° C.

TABLE 1

Glass Temperature (Tg) and Ship Store Ratings

| Toner | Latex | Tg of Latex | Ship/store |
|---|---|---|---|
| Control | PE | ? | 52-57 |
| Toner A | Encapsulated Oil Latex A | 52.0° C. | 91 |
| Toner B | Encapsulated Oil Latex B | 56.5° C. | 74 |
| Toner 1 | IPN Latex 1 | 57.5° C. | 52 |
| Toner 2 | IPN Latex 2 | 60.5° C. | 63 |
| Toner 3 | IPN Latex 3 | 58.2° C. | 56 |

The results in Table 1 demonstrate that the Tg of the latex will not be significantly impacted the addition of a cross-linkable oil in the core of Toners 1, 2 and 3. The Control Toner has an acceptable ship store rating. Toners 1, 2 and 3 having the inventive softening agent in its core consisting of the core shell styrene acrylic latex having an encapsulated IPN microgel have an acceptable ship store rating comparable to the ship store rating of the Control Toner. Toners A and B do not have acceptable ship store scores. This indicates that toners having the inventive softening agent in their respective core consisting of the core shell styrene acrylic latex having an encapsulated IPN microgel does not negatively affect their Tg and ship store characteristics.

Fusing Results

Each toner formulation was printed (but not fused) with toner coverage of 1.1 mg/cm2 on 24# Hammermill laser paper. The unfused sheet was then passed through a fusing robot at 60 ppm with varying heater set point temperatures at 5° C. intervals. For the scratch resistance test, the fused print samples were evaluated using a TABER ABRADER device from TABER Industries, North Tonawanda, N.Y., USA. The printed samples were evaluated on the TABER ABRADER scale from 0 to 10 (where a rating of 10 indicates the most scratch resistance). The TABER ABRADER device scratches the printed samples multiple times with different forces until the toner is scratched off the sample. The point at which the toner is scratched off corresponds with a number rating between 0 and 10 on the TABER ABRADER scale.

Table 2 compares the toner fusing data of the various example toners at a number of fusing temperatures.

TABLE 2

Fusing Data

| Fusing Temp. (° C.) | Control Toner | Toner A | Toner B | Toner 1 | Toner 2 | Toner 3 |
|---|---|---|---|---|---|---|
| 175 | 0 | 0 | | | | CO |
| 180 | 6.667 | 2 | 0 | 0 | 0 | CO |
| 185 | 7.67 | 3 | 9.33 | 0 | 8.33 | 7.33 |
| 190 | 8 | 9.67 | 9.33 | 7.67 | 10 | 9.67 |
| 195 | 8.33 | 10 | 10 | 9.33 | 10 | 10 |
| 200 | 8.67 | 10 | 10 | 10 | 10 | 10 |
| 205 | 9.67 | 10 | 10 | 10 | 10 | 10 |
| 210 | 10 | 10 | 10 | 10 | 10 | 10 |
| 215 | 10 | 10 | 10 | 10 | 10 | 10 |
| 220 | 10 | 10 | 10 | 10 | 10 | 10 |
| 225 | 10 | 10 | 10 | 10 | 10 | 10 |
| 230 | 10 | 10 | 10 | 10 | 10 | 10 |

The fusing data in TABLE 2 demonstrates Toners A and B (having an encapsulated oil as a softening agent in its core) and Toners 1, 2 and 3 (having a core shell styrene acrylic latex having an encapsulated IPN microgel as a softening agent in its core) have a desirable lower fusing temperature compared to the lowest fusing temperature of the Control Toner. While Toners A and B show improvement in fusing compared to the Control Toner, Toners A and B exhibit very undesirable ship store ratings as shown in Table 1. However Toners 1, 2, and 3—having the core shell styrene acrylic latex having an encapsulated IPN microgel as its softening agent—simultaneously fuse at an energy saving low temperature and maintain acceptable ship store properties. It is desirable that core shell emulsion aggregation toner formulations can simultaneously fuse at an energy saving low temperature and maintain acceptable ship store properties. Toners A and B and the Control Toner could not simultaneously fuse at an energy saving low temperature and maintain acceptable ship store properties.

The foregoing description of several embodiments of the present disclosure has been presented for purposes of illustration. It is not intended to be exhaustive or to limit the present disclosure to the precise forms disclosed, and obviously many modifications and variations are possible in light of the above teaching. It is intended that the scope of the present disclosure be defined by the claims appended hereto.

What is claimed is:

1. A chemically prepared toner, comprising:

a core including a first polymer binder, a core shell styrene acrylic latex containing an encapsulated interpenetrating polymer network microgel, a pigment, and a wax; and a shell formed around the core including a second polymer binder, wherein the encapsulated interpenetrating polymer network microgel includes a first acrylate polymer network and a second polymer network having a self-crosslinkable non water soluble silicon oil.

2. The chemically prepared toner of claim 1, wherein the core shell styrene acrylic latex includes a hydrophilic monomer having carboxyl (—COOH) and hydroxy (—OH) functional groups and a hydrophobic monomer having styrene and acrylate functionality.

3. The chemically prepared toner of claim 2, wherein the hydrophobic monomer having acrylate functionality is an alkyl acrylate.

4. The chemically prepared toner of claim 3, wherein the alkyl acrylate monomer is lauryl acrylate.

5. The chemically prepared toner of claim 2, wherein the hydrophilic monomers having carboxyl (—COOH) and hydroxy (—OH) functional groups are hydroxyethyl methacrylate and beta-carboxyethyl acrylate.

6. The chemically prepared toner of claim 1, wherein the self-crosslinkable non water soluble silicon oil is selected from the group consisting of monomethoxysilane, dimethoxysilane, trimethoxysilane, octyltrimethoxysilane, octadecyltrimethoxysilane, monoethoxysilane, diethoxysilane, and triethoxysilane and methacryloxypropylmethyldimethoxysilane.

7. The chemically prepared toner of claim 6, wherein the self-crosslinkable non water soluble silicon oil is octyltrimethoxysilane.

8. The chemically prepared toner of claim 1, wherein the glass transition temperature (Tg) of the core shell latex is between 20° C. and 60° C.

9. The chemically prepared toner of claim 1, wherein the first polymer binder and the second polymer binder each include a polyester resin.

10. The chemically prepared toner of claim 9, wherein the first polymer binder includes a first polyester resin or mixture and the second polymer binder includes a second polyester resin or mixture different from the first polyester resin or mixture.

11. The chemically prepared toner of claim 1, further comprising a borax coupling agent between the outer surface of the core and the shell.

* * * * *